United States Patent [19]

Gautier, Jr.

[11] 4,372,013

[45] Feb. 8, 1983

[54] GROMMET

[76] Inventor: Charlie V. Gautier, Jr., 110 The Village #502, Redondo Beach, Calif. 90277

[21] Appl. No.: 287,310

[22] Filed: Jul. 27, 1981

[51] Int. Cl.[3] ..... A43C 5/00

[52] U.S. Cl. ..... 24/144; 24/101 R

[58] Field of Search ..... 24/141, 101 R, 202

[56] References Cited

U.S. PATENT DOCUMENTS

| | | | |
|---|---|---|---|
| 1,334,163 | 3/1920 | Neuberth | 24/141 |
| 3,328,854 | 7/1967 | Tombari | 24/141 |
| 3,812,809 | 5/1974 | Szlmon | 24/141 |

*Primary Examiner*—Robert Peshock

*Attorney, Agent, or Firm*—George A. Maxwell

[57] ABSTRACT

A novel grommet with improved fabric-engaging retaining means. Said grommet includes a pair of like annular washers arranged at opposite surfaces of the fabric structure, about an opening therein; and a central coupling sleeve engaged through said opening and the washers and having outwardly formed washer-engaging end portions. The washers have axially inwardly disposed fabric-engaging inner surfaces defined by portions of the washers established of plastic material and have flat annular metal portions spaced axially outward from said inner surfaces. The washers next include elongate axially inwardly projecting axially inwardly convergent fabric and plastic penetrating conical projections carried by said metal portions and projecting through and inwardly from said plastic portions. The conical projections on each washer project through the fabric structure, penetrate the plastic portion of the other washer and engage the metal portion thereof. The projections on each washer are spaced circumferentially and radially throughout the major radial and circumferential extent thereof and are offset from and occur between the projections on the other washer.

8 Claims, 11 Drawing Figures

GROMMET

This invention has to do with a grommet structure and is particularly concerned with an improved grommet structure engageable with and through a multi-laminate fabric structure.

Throughout the arts where structures fabricated of woven fabric or cloth are produced and utilized, it is common practice to incorporate annular ring-like grommets in the fabric structures to facilitate engaging ropes or the like through the structures to effect tying or anchoring them down when in use. Such grommets, in addition to defining suitable openings to receive ropes and lines serve the more important function of reinforcing the openings in the fabric structures in which they are engaged. Common grommets of the class here concerned with are simple two-part malleable sheet metal assemblies comprising a first annular washer-like part engageable at one surface of a fabric structure, about a hole established therein, and a second annular washer-like part engageable at the other surface of the fabric structure and having a tubular or sleeve-like neck which extends through the opening in the fabric structure, through the first annular part and which is formed radially outwardly to overlie the first part and to hold the two parts in tight, clamped engagement with the fabric structure. Such grommet structures are well-known to all of those skilled in the art to which my invention relates.

Many fabric structures are subjected to extremely high applied forces when in use and are commonly reinforced in those areas where applied forces are concentrated and where grommets are provided. Reinforcement of such structures is usually attained by the application of reinforcing fabric laminates. It is not uncommon for such reinforced areas in fabric structures to include four or five layers of fabric and, in some instances, ten or more layers of fabric.

In those instances where common two-part malleable sheet metal grommets are engaged in and through multi-laminate reinforced fabric structures of the character noted above, and where high forces are imparted into the grommets and transmitted therefrom into the fabric structures, the applied forces tend to stretch the fabric and cause the laminates adjacent to the grommets to move relative to each other. Such movement of parts results in the grommets becoming disengaged from the fabric structures and rendered incapable of performing their intended function.

In efforts to make grommets more durable and to overcome their tendency to become disengaged from related fabric structures, the prior art has provided numerous special grommets with retaining means to fix them in place and prevent their displacement when in use. Such retaining means have typically included a multiplicity of fabric engaging teeth on the opposing washer-like parts of the grommets. One typical example of such retaining means, well-known to those in the art, comprises annular inwardly projecting serrated flanges about the outer periphery of the washer-like parts.

A principal difficulty or shortcoming found in the above noted types of retaining means provided by the prior art resides in the tendency for the fabric engaging teeth to cut the fibers of the fabric in which they are engaged, thereby weakening the fabric and defeating the end sought to be attained.

In the recent past, a novel and more effective retaining means for grommet structures has been provided by the prior art. That retaining means includes a multiplicity of circumferentially and radially spaced rather short or stubby truncated or radiused conical fabric engaging projections on the opposing surfaces of a pair of related washer-like parts of a grommet structure. The conical projections on the opposing parts are out of register with each other and when the opposing parts are urged into tight, clamped engagement with a related multi-laminate fabric structure, the conical projections on each part urge and form the fabric structure about and between the conical projections on the other part. Such a relationship of parts results in the fabric between the parts being bound in and about the projections. In some instances, the projections penetrate adjacent fabric laminates by parting and/or displacing the fibers of the fabric, but often crush the fibers and weaken the fabric. Most often, the projections do no penetrate the fabric structures sufficiently to prevent the fabric between the projections on the two parts from moving and sliding when pulled or drawn relative to the grommet structure, with resulting failure of the retaining means to effectively perform its intended function.

Those grommet structures including the above noted special form of retaining means are made of a pair of die-cast metal washer parts on which the conical projections are formed and a central malleable metal retaining sleeve engaged through the pair of washer parts and through the fabric structure therebetween and are flared or formed to retain the parts assembled. The die-cast metal parts are excessively heavy and they are so brittle that they are likely to break and fail when subjected to abusive and rigorous environmental conditions where their soundness and serviceability is most needed. The excessive weight of the above noted grommet structures is a major shortcoming.

OBJECTS AND FEATURES OF THE INVENTION

An object of my invention is to provide a grommet structure with highly effective and novel retaining means.

It is another object and feature of my invention to provide a novel grommet structure that includes a pair of related washer-like parts with opposing fabric-engaging inner surfaces and wherein each part has a plurality of circumferentially and radially spaced inwardly projecting conical fabric penetrating teeth which penetrate fabric between the washers and wherein the projections on each washer engage the inner surface of the other washer.

Yet another object and feature of my invention is to provide a grommet structure of the character referred to above wherein the washers are molded plastic parts and the conical projections are metal parts carried by metallic washer-like cores in the plastic parts.

It is an object and feature of my invention to provide a grommet structure of the character referred to above wherein the conical projections on each washer part penetrate the other part and stop at the core of said other part whereby no spaces or gaps occur between the projections and their related other parts, through which fabric arranged between the parts can be caused to move.

Still another object and feature of my invention is to provide a grommet structure of the character referred to above wherein the projections on each washer part are made of malleable metal and are such that they will yield, bend and/or turn when they are urged into engagement with the core in the other part, whereby they do not establish stops which adversely limit movement of the related washers towards each other and into tight clamped engagement with related fabric structures.

It is yet another object and feature of my invention to provide a grommet structure of the character referred to above wherein the projections on each washer part, upon penetrating the plastic material of the other washer part, displace that plastic material causing it to move inwardly into and to exert increased holding pressure on the fabric structure.

It is an object and feature of my invention to provide a fabricated plastic and metal grommet structure of the character referred to above which is light-weight and wherein the plastic and metal materials are not subject to failing when subjected to the most severe environmental conditions likely to be encountered.

The foregoing and other objects and features of my invention will be fully understood from the following detailed description of typical preferred forms and embodiments of my invention, throughout which description reference is made to the accompanying drawings.

DETAILED DESCRIPTION OF THE INVENTION

Figure 1:
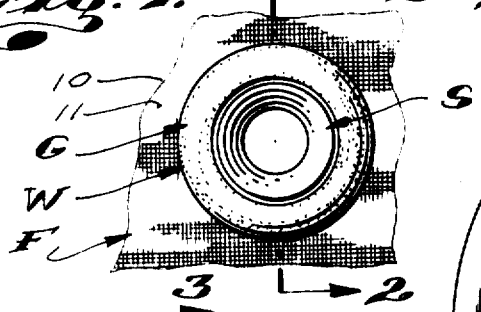
FIG. 1 is an elevational view of a grommet embodying my invention, engaged in a fabric structure.

The grommet G that I provide is adapted to be and is shown engaged in and through an opening O in a multi-laminate fabric structure F and to engage opposite surfaces of the structure F about the opening O therein to effectively protect the opening O and to reinforce the structure F about that opening.

The grommet G includes two like annular washer-like parts W, herein called "washers" and a central tubular coupler sleeve S.

In the case illustrated, the multi-laminate fabric structure F is shown as comprising four flat layers of woven fabric, such as sail cloth, in flat surface-to-surface engagement with each other and through which the opening O has been cut or punched. In practice, the number of laminates can be increased or decreased as desired or as circumstances require and the thickness or weight and stiffness or hardness of the fabric can be varied, without altering or affecting the invention.

In practice, the several layers of fabric are secured together by stitching (not shown) and/or by means of a suitable fabric cement.

In the case illustrated, the structure F includes two outside layers of fabric 10 defining oppositely disposed outside surfaces 11 and two inside layers of fabric 12.

Each of the two like washers W inlcude a substantially flat radially extending annular body B of molded plastic. The plastic body B has a flat inwardly disposed radially extending inner surface 20, a cylindrical radially inwardly disposed bore 21, a cylindrical outer edge portion 22, and an outwardly disposed substantially radially extending outer surface 23.

In practice, the plastic material of which the bodies B are established can be any readily moldable plastic which is substantially non-brittle, strong and durable, resistant to degradation when subjected to the environments to which the grommet is likely to be subjected, and which is lightweight. One preferred material is that well-known plastic sold under the tradename Zytel.

In the preferred carrying out of the invention, the outer end portion of the bore 21 of each washer is radiused axially and radially outwardly as shown in the drawings. The outer edge portion 22 of each washer is preferably radiused as shown. In the case illustrated, the radial outer portion of the outer surfaces 23 of the washer bodies are radially outwardly and axially inwardly inclined to reduce the bulk and weight of the construction; and the radial inner portions of the outer surfaces 23 can be recessed, as at 23', to accommodate their related flared portions of the coupling sleeve S, as clearly shown in FIG. 2 of the drawings.

In addition to the above noted body B, each washer W includes a flat annular metal washer-like core C, arranged within the molded plastic body B to extend radially therein, in axial spaced relationship from the inside surface 20 of the body. The core C of each washer is preferably established of thin, tough and durable stainless steel and is a lightweight part. The core C in each washer has axially inwardly and outwardly disposed inner and outer surfaces 25 and 26 and has radially inner and outer edges 27 and 28. In addition to the foregoing, in the form of the invention illustrated, the core C of each washer is provided with a plurality of circumferentially and radially spaced openings 29.

In furtherance of the invention, the core C and body B of each washer W carry a plurality of radially and circumferentially spaced axially inwardly projecting axially inwardly convergent conical retaining projections P. The projections P have sharp inner ends 30 and smooth, non-abrading conical outside surfaces 31.

In addition to the above, the projections P have flat outer ends which stop on the inner surfaces 32 of their related cores C and have axially outwardly projecting cylindrical rivet like stems 33 which project through related openings 29 in their related cores c. The outer ends of the stems 33 are peened or formed over the outer surfaces 26 of their related cores C, as clearly shown at 34 in the drawings.

The projections P are established of a suitable malleable metal such as brass and are sufficiently long or great in axial extent so that when the grommet G is engaged with the fabric structure F, the projections project axially inward from the inner surfaces 20 of their related washer, project through the fabric structure F and penetrate the inner plastic portion of their other related washer. The projections preferably penetrate said other related washer a sufficient extent to engage the inner surface 25 of the core C in said related washer.

When the projections P of each washer W penetrate the body of the other washer W, they displace plastic material of the other washer. That displaced material has no place to go but radially and axially inward, with the result that it moves into tight pressure engagement with its related fabric structure, exerting increased pressure engagement therewith.

Of equal significance, the noted displaced plastic material serves to "bury" the tip portions of the projections P deeper into their related washers and assures closing of any spaces or gaps between the tips of the projections and the washer.

In practice, if the thickness of the fabric structure F is not sufficient to permit the washers to be moved into desired pressure engagement with the fabric structure when the tips of the projections engage their related cores C, upon further urging of the washers together, the tips of the projections are displaced or bent over by the cores to extend substantially radially at the radial planes of the inside surfaces 20 of the cores until the washers move inwardly a sufficient extent to establish desired clamping pressure engagement on and with the fabric structure F. When such forming of the tips of the projections P occurs, additional plastic material, inward of the cores C, is displaced by the projections to enhance the interengagement of parts and the effective holding pressures exerted thereby.

While I have elected to show the projections P riveted to their related cores C, it is believed obvious and apparent that they can be fixed to the cores in other ways or by other means without departing from the spirit of my invention. Further, the angle of convergence and the axial extent of the projections P can be varied without departing from the spirit of my invention.

It has been determined that by suitably proportioning the axial extent or length of the projections P and the thickness of the portions of the bodies B occurring axially inward of the cores C, the range of thickness of laminate fabric structures with which each size of my new grommet structure can be effectively engaged is comparable with the range of thickness of laminate fabric structures, different standard sizes of common grommets can be related. Accordingly, my invention is not such that an extraordinary or notably greater number of different sizes of grommets need be produced and stocked.

Figure 2:
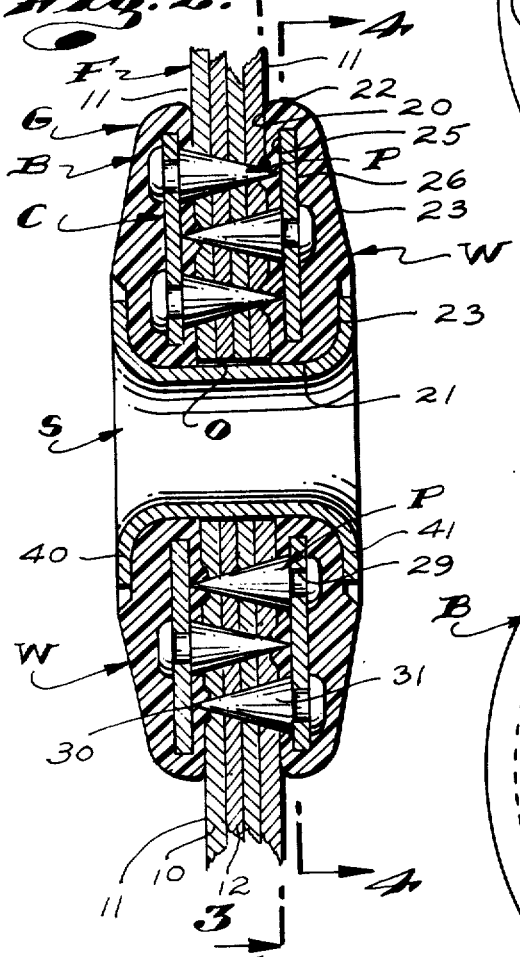
FIG. 2 is an enlarged detailed sectional view taken as indicated by line 2—2 on FIG. 1.
Figure 4:
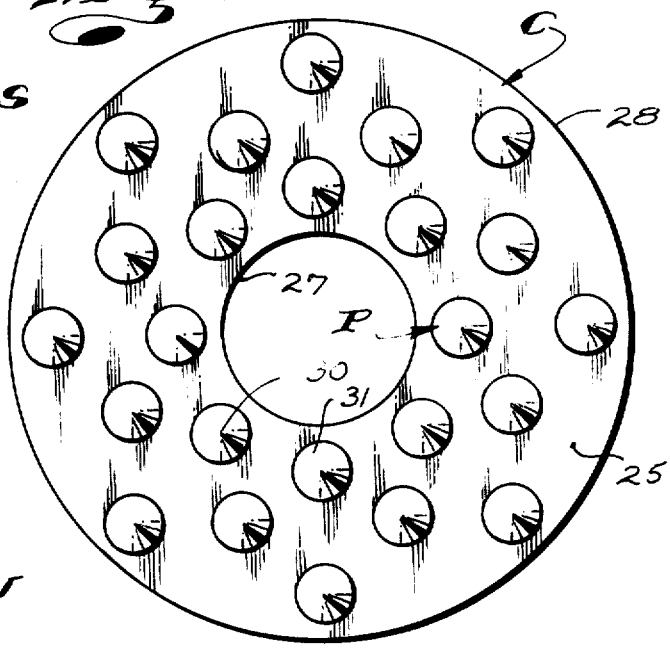
FIG. 4 is a view taken substantially as indicated by line 4—4 on FIG. 2.
Figure 3:
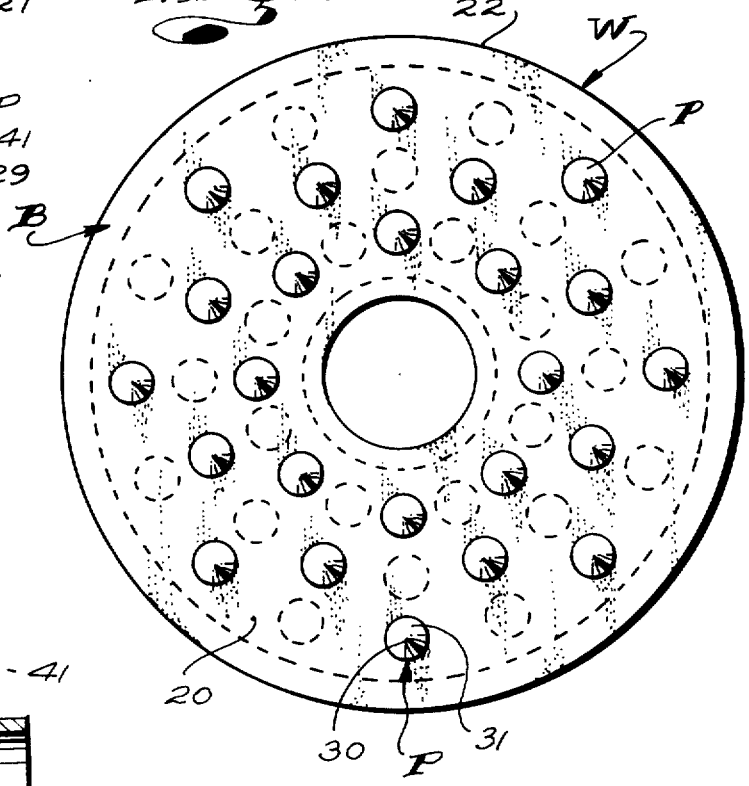
FIG. 3 is a view taken substantially as indicated by line 3—3 on FIG. 2.
Figure 5:
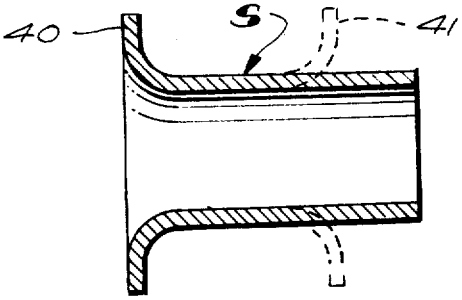
FIG. 5 is a view of a part of the grommet structure.
Figure 6:
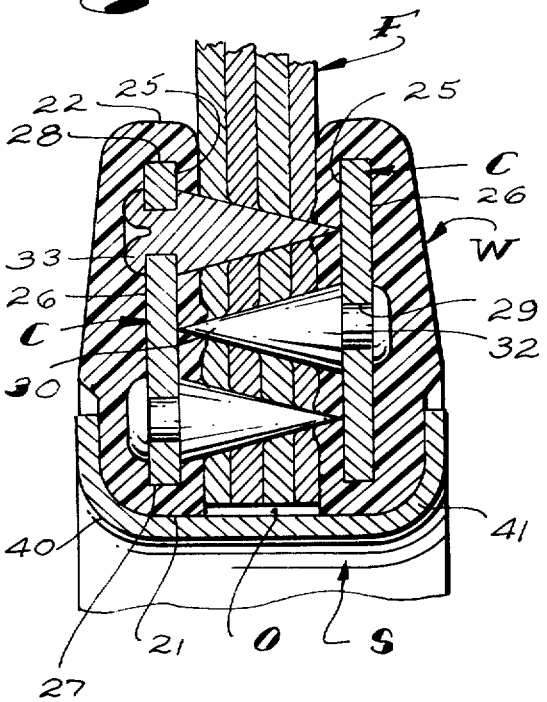
FIG. 6 is an enlarged detailed sectional view of a portion of the structure shown in FIG. 2 with parts shown in section to better illustrate the invention.
Figure 7:
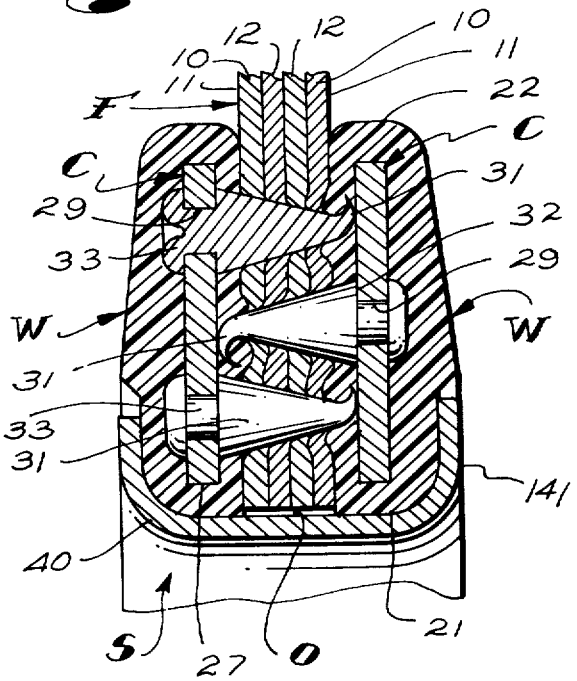
FIG. 7 is a view similar to FIG. 6 showing the parts in another position.

In practice, and in use, when my new grommet G is related to the fabric structure F, the coupling sleeve S, which has one initially flared end 40, is engaged through one washer W with its flared end 40 seated therein, as shown at the right-hand side of FIG. 2 of the drawings and with its unflared free end projecting from that washer. The free end of the sleeve is engaged through the preestablished opening O in the fabric structure F and the sub-assembled washer and sleeve are advanced toward the structure F and are manually worked to urge the projections P of that sub-assembly into partial engagement in or, if possible, through the fabric structure. Thereafter, the other washer (at the right-hand side of FIG. 2 of the drawings) is slidably engaged about the free end of the sleeve (projecting from the right-hand side of the structure F) and is manually worked and urged axially inwardly into engagement with the structure F to as great an extent as is possible. If the projections P on the two washers are in interfering alignment, relative manual working of the parts will cause relative circumferential shifting of the washers and resulting non-aligned relationship of the projections. When the assembly of parts is thus manually established, a suitable press and forming tool (not shown) is employed to press the washers together and into tight pressure engagement with the fabric structure F, during which pressing of parts, the projections P are urged into set position and the free end of the sleeve S is flared and formed to seat in the right-hand washer W, as shown at 41 in FIG. 2 of the drawings and as shown in dotted lines in FIG. 5 of the drawings. When the sleeve S is thus formed and seated in and with the washers W, the washers are permanently retained in tight clamped engagement with the fabric structure and installation of the grommet is completed.

In practice, the exerting of 2,500 psi in and through the assembly of parts to effect installation of the grommet structure would not be unusual or excessive.

The press and forming tool employed in carrying out the above noted installation of my new grommet is not notably different from common grommet presses, which are well-known to those skilled in the art.

Figure 8:
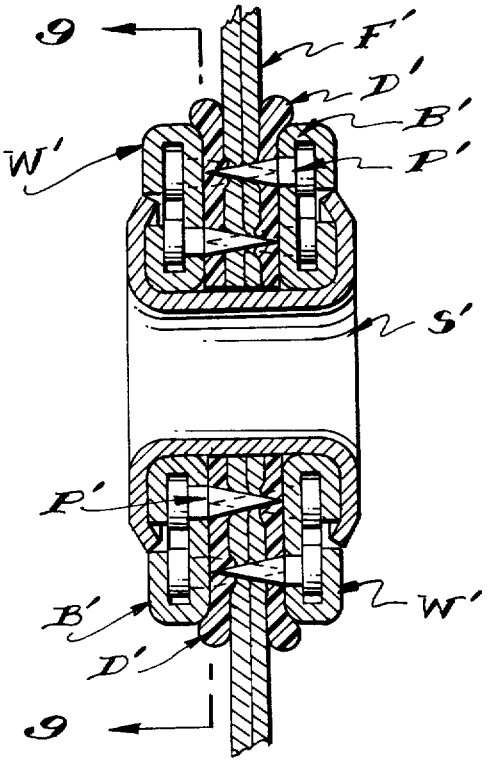
FIG. 8 is a cross-sectional view similar to FIG. 2 showing another form of my invention.

In FIG. 8 of the drawings, I have shown another form of my invention which is lighter and less bulky than the form of the invention described above. In this second form of the invention, what was the cores C in the first form of the invention establish the bodies B' of the washers W' and plastic discs D' are arranged inward of the bodies B', into which the tips of the projections P', carried by the bodies B', are set. The conical projections P' are headed parts engaged through openings in the bodies B' and which are retained in fixed engagement in their related openings by radially extending retaining flanges on and about the inner and outer peripheries of the bodies, as clearly shown in the drawings.

Figure 10:
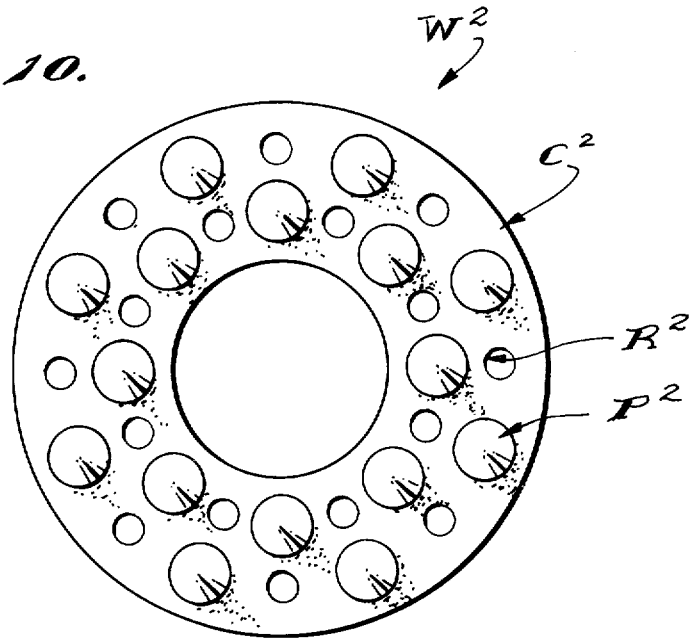
FIG. 10 is a view of a metal core part embodying another form of the invention.
Figure 11:
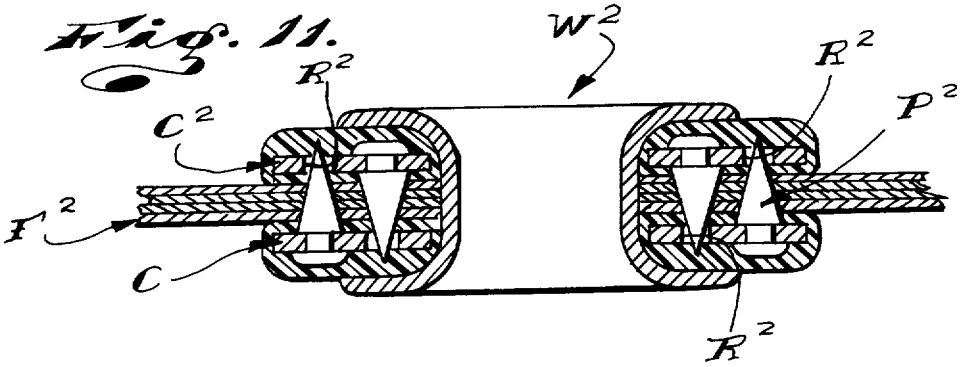
FIG. 11 is a cross-sectional view of a grommet embodying the form of core parts shown on FIG. 10.

In FIGS. 10 and 11 of the drawings, I have illustrated another form of my invention wherein the washer-like metal portions or cores $C^2$ of the washers $W^2$ are provided with radially and circumferentially spaced axially extending through openings $R^2$. The openings $R^2$ in each washer $W^2$ are in substantial axial alignment with the projections $P^2$ on the other washer $W^2$ and substantially freely accommodate the tip end portions of those projections when the axial displacement of the metal portions or cores $C^2$ is less than the effective axial extent of the projections $P^2$, when the grommet structure is set and fixed in and with its related fabric structure $F^2$.

The washer structure $W^2$ is such that the washers can be moved axially closer together and effectively engage thinner fabric structure $F^2$ than is possible with the other forms of the invention since the projections $P^2$ do not establish interfering engagement with the cores $C^2$, unless or until a substantial portion of the projections are moved through the openings $R^2$ and their tapered exterior surfaces "bottom out" in the openings $R^2$.

Further, in the last noted form of the invention, the openings $R^2$ can be and are preferably established by removing metal and therefore serve the secondary end of reducing the weight of the washers $W^2$, without adversely weakening the structure.

Figure 9:
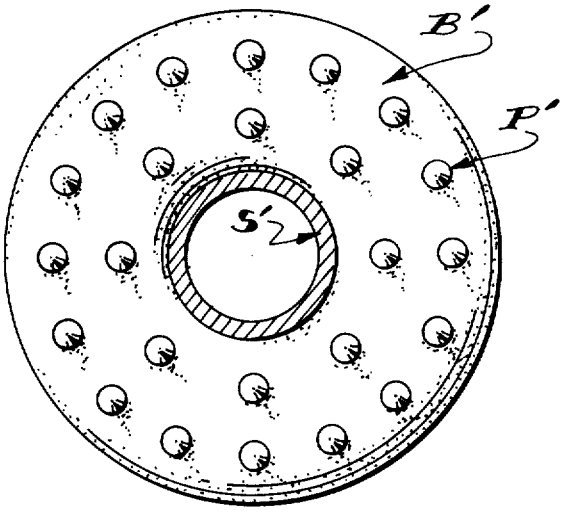
FIG. 9 is a view taken substantially as indicated by line 9—9 on FIG. 8.

In the form of the invention shown in FIGS. 2, 3, 4, 6 and 7 of the drawings, the washers W are provided with three radially spaced annular rows or series of projections P, while in the forms of the invention shown in FIGS. 8 and 9 and in FIGS. 10 and 11, the washers W′ and $W^2$ are provided with two radially spaced annular rows or series of projections P′ and $P^2$. In FIGS. 8 and 9, the radial and circumferential spacing of the projections P′ is notably greater than the radial and circumferential spacing of the projections $P^2$ in FIGS. 10 and 11 of the drawings. The noted differences in the arrangement of the projections P, P′ and $P^2$ clearly demonstrates and makes it clear that the arrangement, number and spacial relationship of the projections can be varied greatly without departing from the spirit and broad aspects of my invention.

The several forms or embodiments of the invention illustrated and described in the foregoing clearly establishes the fact that the form and details of construction of grommets embodying my invention can be varied substantially without departing from the broader aspects and spirit of the invention.

Having described my invention, I claim:

1. A grommet comprising a pair of annular washers with flat opposing axially disposed inner surfaces engaged with axially outwardly disposed outer surfaces on a multi-laminate fabric structure and concentric with and about an opening in said structure, an elongate coupling sleeve concentric with and engaged through said opening and through said washers and having radially outwardly flared opposite end portions engaging axially outwardly disposed outside surfaces on said washers and holding said washers and fabric structure in tight assembled relationship, said washers have annular plastic inner portions engaged with said outer surfaces of the fabric structure, flat annular metal portions outward of said plastic inner portions and a plurality of circumferentially and radially spaced inwardly convergent metal projections projecting axially inwardly from the annular metal portion of each washer through the inner plastic portion thereof, through said fabric structure and penetrating the plastic portion of the other washer.

2. The grommet set forth in claim 1 wherein the projections on one washer occur in spaced relationship between adjacent washers on the other washer.

3. The grommet set forth in claim 2 wherein the projections displace material of said plastic portions into pressure engagement with the fabric structure.

4. The grommet set forth in claim 2 wherein the projections displace material of said plastic portions into pressure engagement with the fabric structure and wherein said projections of each washer engage the annular metal portion of the other washer.

5. The grommet set forth in claim 4 wherein the inner convergent end portions of said projections are deflected by the annular metal portions and project substantially laterally in said annular plastic portions.

6. The grommet set forth in claim 1 wherein the annular metal portion of each washer has axially extending through openings substantially concentric with the projections of the other washer and into which those projections project.

7. The grommet set forth in each of claims 1, 2, 3, 4 or 5 wherein the washers have plastic portions formed integrally with said inner annular plastic portions and encapsulating said annular metal portions.

8. The grommet set forth in each of claims 1, 2, 3, 4, 5 or 6 wherein said annular metal portions are thin, flat sheet metal parts and said projections are metal parts with outer base ends fixed to said annular metal portions.

* * * * *